US006318280B1

(12) United States Patent
Vornholt

(10) Patent No.: US 6,318,280 B1
(45) Date of Patent: Nov. 20, 2001

(54) SEWING MACHINE NEEDLE HAVING OFFSET EYE WEBS

(75) Inventor: Harry Vornholt, Bitz (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/660,557

(22) Filed: Sep. 12, 2000

Related U.S. Application Data

(63) Continuation of application No. 09/570,388, filed on May 12, 2000.

(30) Foreign Application Priority Data

May 12, 1999 (DE) ..... 199 21 914

(51) Int. Cl.[7] ..... D05B 85/02
(52) U.S. Cl. ..... 112/222
(58) Field of Search ..... 112/222, 224

(56) References Cited

U.S. PATENT DOCUMENTS 4,037,641 7/1977 Zocher .
4,233,917 * 11/1980 Carnaby ..... 112/222
4,458,614 * 7/1984 Iwashita ..... 112/222
4,502,403 3/1985 Carnaby .
5,215,021 * 6/1993 Fuhrmann ..... 112/222
6,062,151 * 5/2000 Meade et al. ..... 112/222

FOREIGN PATENT DOCUMENTS 2 412 062 10/1974 (DE) .
30 27 534 2/1982 (DE) .
2 125 074 2/1984 (DE) .
0 882 831 12/1998 (EP) .
2 041 021 9/1980 (GB) .

* cited by examiner

*Primary Examiner*—Ismael Izaguirre
(74) *Attorney, Agent, or Firm*—Venable; Gabor J. Kelemen

(57) ABSTRACT

A sewing machine needle includes a substantially linear blade having a longitudinal axis and terminating in a needle point and an eye provided in the blade. The eye is bordered by two eye webs which are spaced from one another parallel to the axis and which are offset relative to one another transversely to the axis.

15 Claims, 3 Drawing Sheets

SEWING MACHINE NEEDLE HAVING OFFSET EYE WEBS

CROSS REFERENCE TO RELATED APPLICATION

This application is a continuation of co-pending application Ser. No. 09/570,388 filed May 12, 2000.

This application claims the priority of German application No. 199 21 914.1 filed May 12, 1999, which is incorporated herein by reference.

BACKGROUND OF THE INVENTION

This invention relates to a sewing machine needle, particularly for rapidly operating sewing machines.

As a rule, current industrial sewing machines operate with a speed of 5000 stitches per minute or more. In some cases even 8,000 stitches per minute are exceeded.

Upon penetration of the needle into the material to be sewn (hereafter referred to as fabric), the needle opens a stitch hole and pulls the thread (sewing yarn) into the stitch hole. At very high stitch numbers per minute only a very short period of approximately 0.5 ms or less is available for opening the stitch hole. Such a period starts at the moment the needle point contacts the fabric and lasts until the needle eye passes through the fabric. Because of an almost explosive opening of the stitch hole, large friction forces are generated between the needle and the fabric. Therefore, relatively large penetration Forces are needed which, in turn, increase the energy requirement for the needle penetration.

Because of the large frictional forces produced between the needle and the fabric during opening of the stitch hole, heat is generated which may thermally damage the fabric. For example, synthetic fibers may be melted or fused in the region of needle penetration. Also, fibers or fiber bundles may be mechanically damaged by the explosive opening of the stitch hole. A further consequence is the frequent sewing yarn breakage.

Further, the sewn article, dependent on the fabric, may be adversely affected by the fusion of laminates and layers as well as dye or finishing materials. These problems may lead to a significantly deteriorated seam quality and an affected wearability of garments made of such fabrics.

The above-outlined disadvantages have led to the desideratum to reduce the size of the stitch holes. In most cases, however, this objective is limited by the given yarn thickness and the size of the sewing machine needle necessary for guiding the yarn. A certain sewing yarn thickness determines a certain minimum needle thickness. Further, the size of the needle eye increases similarly to the needle thickness. An additional problem encountered in sewing machine needles is the mechanical stress on the needles, particularly at high-speed operation. The rotating masses in the sewing machine may generate vibrations which particularly affect the unilaterally clamped sewing machine needles. Further, thread pull, excursion of the needle as it contacts the fabric and manipulations by the operating personnel produce additional external forces. These factors lead to the desideratum to use thick sewing machine needles which have a sufficient rigidity. To use, on the one hand, a possibly thin needle for ensuring a gentle handling of the fabric and for avoiding an excessive heat-up of the needle and to use, on the other hand, a possibly thick needle for ensuring a required stability in case of high sewing speeds are contradictory requirements.

U.S. Pat. No. 4,037,641 describes a sewing machine needle having a straight blade which, in the vicinity of the needle point, has a needle eye passing through the blade transversely to the longitudinal needle axis. In the axial direction the eye is bordered by two facing eye webs which lie essentially on the central longitudinal axis of the needle. The needle is provided with a thread trough which merges into the eye and extends towards the needle shank which is clamped to the sewing machine. On the side remote from the thread trough a further, short trough is provided which extends toward the needle point and which runs out flat in the immediate vicinity at the needle eye. On the same side of the needle a depressed blade portion adjoins the eye and extends in the direction of the needle shank. The eye web situated between the thread trough and the depressed portion and rounded on its side serves for pulling the thread into an opened stitch hole.

By virtue of the approximately central arrangement of the eye web with respect to the needle blade, during needle penetration into the fabric, the thread runs on one side of the needle in the needle trough while on the other side of the needle the thread is essentially situated in the depressed blade portion. The eye region of the needle is oriented transversely to the central axis and is dimensioned in the opening direction of the eye in such a manner that the opened hole in the fabric is relatively large. As a result, the above-described disadvantageous occurrences may take place.

As the sewing machine needle is pulled out of the fabric in the course of the return stroke of the needle, the thread runs in an S-shaped curve through the eye. The friction generated in this instance produces forces between the needle and the thread and thus causes a heat-up.

SUMMARY OF THE INVENTION

It is an object of the invention to provide an improved sewing machine needle particularly for addressing the above-discussed problems and disadvantages.

This object and others to become apparent as the specification progresses, are accomplished by the invention, according to which, briefly stated, the sewing machine needle includes a substantially linear blade having a longitudinal axis and terminating in a needle point and an eye provided in the blade. The eye is bordered by two eye webs which are spaced from one another parallel to the axis and which are offset relative to one another transversely to the axis.

The sewing machine needle according to the invention has an essentially straight blade. It has no offset portions in which parts of the blade project beyond the unweakened blade contour. As a result, the needle, as it penetrates into the fabric, does not push aside laterally the flanks of the stitch hole, whereby an acceleration of the fabric in the lateral direction and friction caused thereby are avoided.

The sewing machine needle according to the invention has two eye webs which are spaced from one another and which are offset relative to the central longitudinal needle axis. The offset is designed preferably such that the eye web which is oriented towards the needle shank (that is, the clamped part of the needle) provides for a barrier-Free transition into the eye. Thus, the offset is situated at that side of the needle which is remote from the thread trough. On the other hand, the eye web which is oriented towards the needle point is offset towards the other side of the eye and is positioned approximately in an imaginary prolongation of the thread trough. These measures altogether provide for a reduced friction between the thread and the needle and also between the needle and the fabric during needle penetration into the fabric The offset of the eye webs with respect to one another results in a reduction of the height of the needle in the zone of the eye as compared to the nominal size of the needle without adversely affecting the needle stiffness. The height of the needle is perpendicular to the needle axis and is measured in a direction which passes through the eye.

The reduction of friction between the needle according to the invention and the fabric becomes particularly evident upon penetration of the needle into the fabric. In the course of the return stroke, the offset of the eye webs makes possible a thread course of reduced deflection in the region of the eye so that, again, no substantial friction is generated.

The needle according to the invention operates with a reduced penetrating force which leads to a lower energy requirement for driving the needle. Further, the needle s heated to a lesser extent because of the reduced friction. At the same time, the fabric is handled gently during the stitch hole opening process, and the thread is protected to a highly satisfactory extent. The probability of misses in the stitching and thread breakage is significantly reduced.

According to an advantageous feature of the invention, the eye webs are rounded and are free from edges. In case of a desired eye web thickness which is 50% of the nominal needle thickness, the rounding of the upper web, that is, the eye web oriented towards the clamped needle portion, has preferably a radius which is 20% of the nominal needle thickness. Such a relationship results altogether in a very satisfactory thread run.

The eye webs are offset with respect to one another transversely to the central needle axis by a distance which is at least 40%, but not more than 50% of the nominal needle thickness. As a result, the protection of the thread may be optimized as it passes in a stretched state through the eye.

The thickness of the eye webs is preferably one-half the nominal needle thickness. This provides for a slender sewing machine needle in the eye region and also a highly satisfactory stability and rigidity.

The point of the needle may lie on the central needle axis which medially traverses the passage defined by the eye. If required, however, the needle point may be offset relative to the central axis. Independently from these considerations, it is expedient to arrange the eye webs in such a manner that an imaginary line, which passes through the eye and is tangent to the inner faces of the eye webs, forms an acute angle of less than 20° with the central needle axis. The eye web offset and, at the same time, the small acute angle of the tangent passing through the eye web ensure a low friction between the thread and the sewing machine needle even if the eye is relatively narrow in the direction of the central needle axis.

The friction may be further reduced by a concave configuration of the eye webs.

Expediently, the sewing machine needle has a relatively short eye in which the distance between the eye webs, measured in the axial direction, is in the range from 1 to 1.1 times of the nominal needle thickness. This results in an accurate guidance of the thread and may lead to a reduction of the required penetration depth.

The eye wall faces defining the eye passage are preferably non-planar and they are divergent towards both eye openings. Further, the angle formed between the eye walls and measured transversely to the central needle axis may vary along the needle axis. Such an arrangement improves the thread run through the eye and reduces friction between thread and eye wall. At the same time, the bilateral support of the thread loop required for providing the stitch looping is ensured.

In the vicinity of the eye, on the needle side opposite from the thread trough, a depressed (hollow) needle portion may be provided which merges into the eye without any sharp edge for enhancing the protection of the thread.

According to an advantageous feature of the invention, the needle has eye walls which do not project beyond the eye web that is oriented towards the clamped part of the needle. This arrangement results in a relatively small needle cross section in the eye region and in a relatively slow opening of the stitch hole as well as a gentle handling of the fabric.

DESCRIPTION OF THE PREFERRED EMBODIMENT

Figure 3:
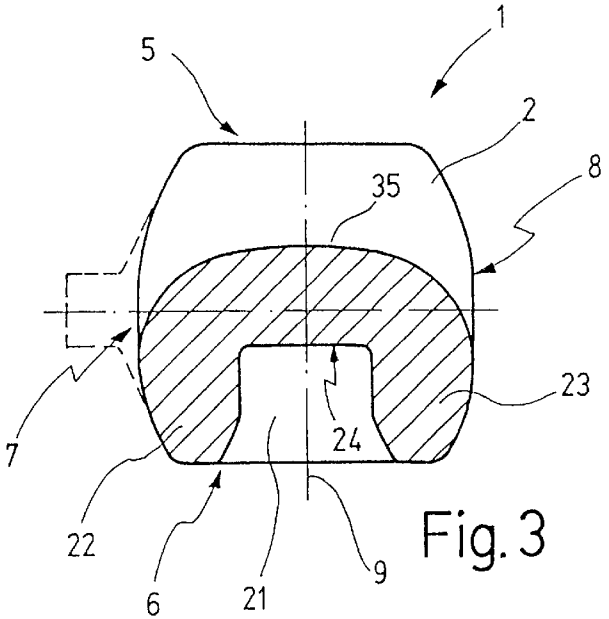
FIG. 3 is a sectional view taken along line III—III of FIG. 1 without thread.
Figure 1:
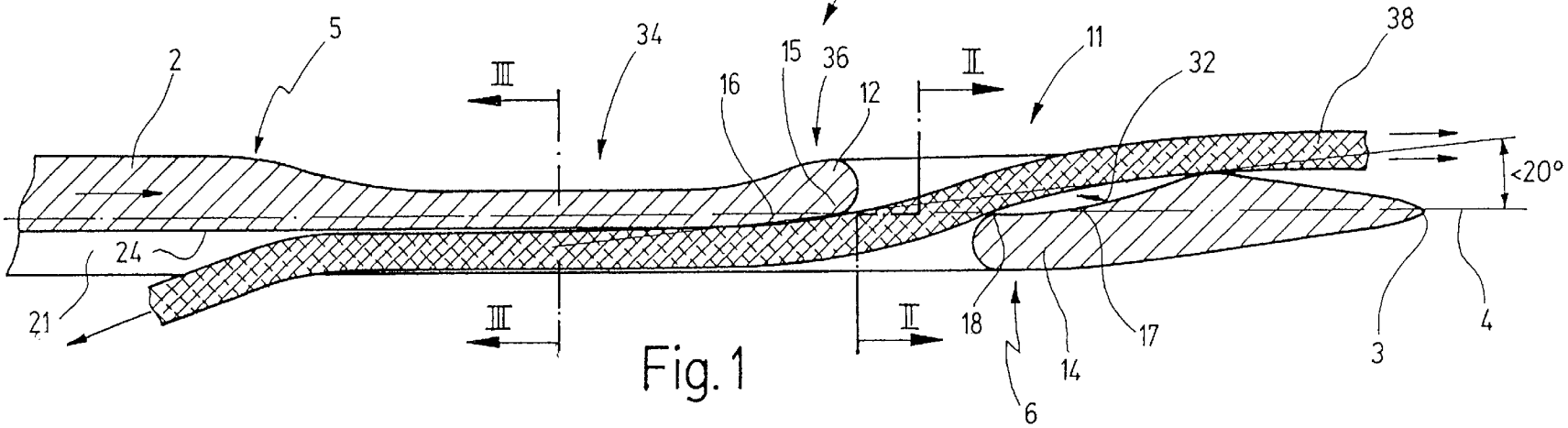
FIG. 1 is a simplified axial sectional view of a terminal portion of a preferred embodiment of the sewing machine needle showing a thread running straight through the needle eye.

FIG. 1 shows a sewing machine needle 1 having a blade 2 which extends from a non-illustrated shank (clamped needle portion) to a needle point 3 along a central longitudinal axis 4 which preferably contains the point 3. The blade 2, as shown in FIG. 3, has flattened opposite upper and lower surfaces 5 and 6. The lateral surfaces 7 and 8 which are situated between the surfaces 5 and 6 are of convex configuration. The cross section of the needle 1 is, in the region of unreduced blade thickness, generally square, apart from the convex bulging of the surfaces 7 an 8. The nominal needle thickness is the diameter of the needle in the blade region past the depressed portion in the direction of the clamped needle part.

Figure 2:
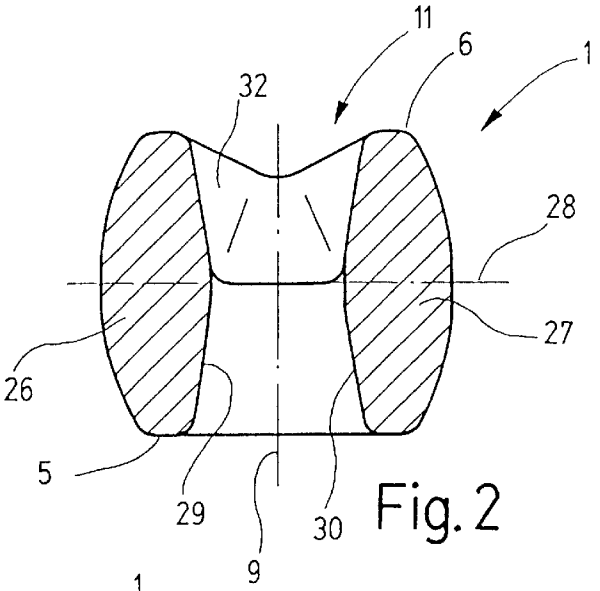
FIG. 2 is a sectional view taken along line II—II of FIG. 1 without thread.

Also referring to FIG. 2, a needle eye 11 situated in the vicinity of the point 3 passes through the blade 2 transversely to the longitudinal needle axis 4. The height of the eye 11 is determined by the distance between the blade sides 5 and 6. In the region of the eye 11 the needle is preferably slightly thinner than in the blade region of unreduced thickness, shown at the far left in FIG. 1. In the example described, the thickness reduction of the blade 2 in the region of the eye 11 is approximately 5 to 20%, preferably approximately 10% of the region of unreduced thickness between the blade sides 5 and 6.

In the axial direction indicated by the central axis 4, the eye 11 is bordered by two eye webs 12 and 14 which are situated on opposite sides of the needle axis 4 and are thus offset relative to one another in the direction towards the thread thru 21 or the depressed portion as viewed along the axis 4. At their end surfaces bordering the eye 11, the eye webs 12, 14 are each approximately semi-circularly rounded. The radius of curvature of the rounding is, relatively accurately, one-half the thickness of the respective eye web 12, 14. The offset between the two eye webs 12, 14 measured transversely, that is, vertically as viewed in FIG. 1, is approximately 40–50% of the nominal needle thickness. As a result of such a dimensioning, the bottom surfaces 16 and 17 of the respective eye webs 12 and 14 lie approximately on the axis 4 on opposite sides thereof. At a location 15 the rounded end surface of the eye web 12 merges without any kink line or projection into the bottom surface 16 which, as viewed along the axis 4, is elongated and of concave shape. An imaginary tangent line which may be positioned on the transitional region between the bottom surface 16 and the rounded end of the eye web 12 either lies on the central axis 4 or forms therewith an acute angle of a few degrees.

Similar considerations apply to the eye web 14 which too, has a concavely curved bottom surface 17 over which the thread passes. A location of transition 18 between the bottom surface 17 and the rounded end surface of the eye web 14 is situated approximately on the central axis 4 and a tangent at this location approximately coincides with the central axis 4. An imaginary line which passes through the eye 11 and which is tangent to locations or the bottom surfaces 16, 17 forms, with the central axis 4, an acute angle of a few degrees, preferably less than 20°.

The eye 11 is relatively narrow. In the axial direction defined by the central axis 4, the length of the eye defined by the axial distance between the end surfaces of the eye webs 12, 14 is preferably approximately 1 to 1.1 times the nominal thickness of the needle 1 to ensure a highly satisfactory thread guidance. Despite the relatively short eye 11 resulting from such a dimensioning, by virtue of the offset of the eye webs 12, 14 an straight running thread run is obtained. Embodiments are feasible, however, in which the length of the eye is greater or smaller than 1 to 1.5 times the nominal needle thickness.

On the side 6 of the blade 2 a thread trough 21 is formed which merges in the eye 11 and extends therefrom in a direction away from the needle point 3. The thread trough 21 has two side walls 22, 23, as shown in FIG. 3. The side walls 22, 23 have two, substantially planar, mutually parallel flanks which have a portion that widens towards the blade side 6 (that is, toward the open side of the trough 21). Further, the thread trough 21 has a substantially planar bottom 24 which extends parallel to the central axis 4 at a small distance therefrom. At a distance from the eye 11 which corresponds approximately to the needle thickness, the trough bottom 24 merges into the bottom surface 16 of the eye web 12. The bottom surface 16 extends from the trough bottom 24 at an acute angle to the central axis 4.

As may be best observed in FIG. 2, the eye 11 is bordered by two eye walls 26 and 27 whose thickness, as measured along line 28 of FIG. 2 transversely to the eye 11, is slightly less than the inner width of the eye 11 along the line 28 traversing the central axis 4. The flanks of the thread trough 21 have a seamless transition into the inner surfaces 29, 30 of the eye walls 26, 27 at the location where the thread trough 21 merges into the eye 11. In this arrangement, the angle formed between the flanks of the thread trough or the inner faces 29, 30 measured transversely to the central axis 4 may vary along the central axis 4. While the flanks of the thread trough 21 are Parallel to one another in the region of the cross section shown in FIG. 3, the inner surfaces 29, 30 of the respective eye walls 26, 27 form an acute angle with one another in the region of the cross section of FIG. 2. The inner surfaces 29, 30 are divergent towards the upper and lower needle side (as viewed in FIGS. 1 and 2), so that the eye 11 has an hourglass shape as viewed in a sectional plane that is perpendicular to the needle axis 4. Starting from the eye 11 a short, flat-ended trough 32, bordered by the bottom surface 17, extends towards the needle point 3 and terminates approximately halfway before reaching the needle point 3. In this region, the needle has an approximately circular, reduced cross section which gradually decreases in the direction of the needle point 3, whereby this region tapers conically toward the point 3.

At that side of t he eye 11 which is oriented away from the point 3 the blade 2 has a depressed (hollow) portion 34 which is situated on the blade side opposite the thread trough 21. As seen in FIG. 3, the depressed portion 34 has a cross-sectionally convex bottom 35 which merges with a rounding into the side faces 7 and 8 of the needle 1. The rounded transitions serve for relieving stress on the fabric and thus ensure a gentle handling thereof. A transitional region 36 which extends from the depressed portion 34 to the eye 11, as seen in FIG. 1, is also rounded. The transitional portion 3 is formed by the e ye web 12; the transition from its rounded end to the outer side is free from edges. The eye walls 26, 27 have, from the transitional location of the rounded end of the eye web 12 to the side 5 of the needle 1, identical heights without projecting beyond the eye web 12 upwardly as viewed in FIG. 1. While the lower end of the eye 11 as seen in FIG. 1 is at the same height as the entire side 6 of the needle 1, the upper end of the eye 11 is slightly lower than the side 5, at least in the needle region of unreduced thickness. Stated differently, the height of the eye walls 26, 27 measured parallel to the line 9 of FIG. 2 is slightly less than the nominal needle thickness.

In the description which follows, the operation of the described sewing machine needle 1 will be described.

During the sewing operation, the needle 1 is rapidly reciprocated parallel to its longitudinal axis 4. As the needle 1 first moves away from the fabric oriented generally perpendicularly to the axis 4 and arranged in front of the point 3, a thread (sewing yarn) 38 running through the eye 11 is first guided in a stretched condition through the thread trough 21 and the short trough 32. During this occurrence, the thread 38 is under tension so that it lies punctually against the bottom surfaces 16, 17 of the respective eye webs 12, 14. By virtue of the concave shape of the bottom surfaces 16, 17 a face-to-face engagement between the thread and the bottom surfaces is avoided.

Figure 4:
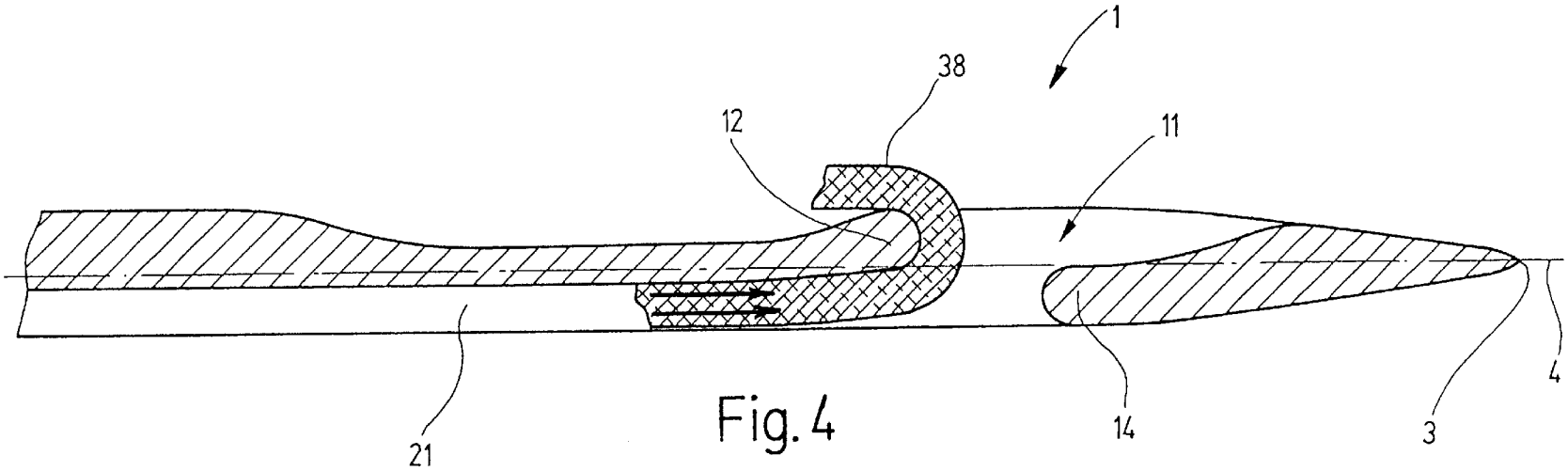
FIG. 4 is a view similar to FIG. 1, depicting the position of the thread during needle penetration.

As the needle reverses its direction of motion and pierces the fabric, the condition depicted in FIG. 4 is reached. The point 3 opens a stitch hole in a fraction of a millisecond. The needle penetrates into the stitch hole up to its eye 11 while the stitch hole is widened. Such a widening occurs relatively gradually, as a result of which the friction between the needle 1 and the fabric is reduced to an acceptable magnitude even at high sewing speeds (that is, at high stitch numbers per minute).

The needle 1 and its eye 11 traverse the fabric; during this occurrence the thread 38 is positioned about the eye web 12. As viewed in FIG. 4, the upper portion of the thread 38 moves slowly relative to the fabric and is substantially at rest. As illustrated by arrows in FIG. 4, the penetrating needle 1 pulls, with high speed, the thread portion positioned in the thread trough 21. An excessive friction between the thread 38 and the fabric is substantially minimized due to the significant depth of the thread trough 21. An excessive friction at the eye web 12 is minimized by virtue of the web rounding and its substantial thickness which approximately equals, for example, the diameter of the thread 38.

Figure 5:
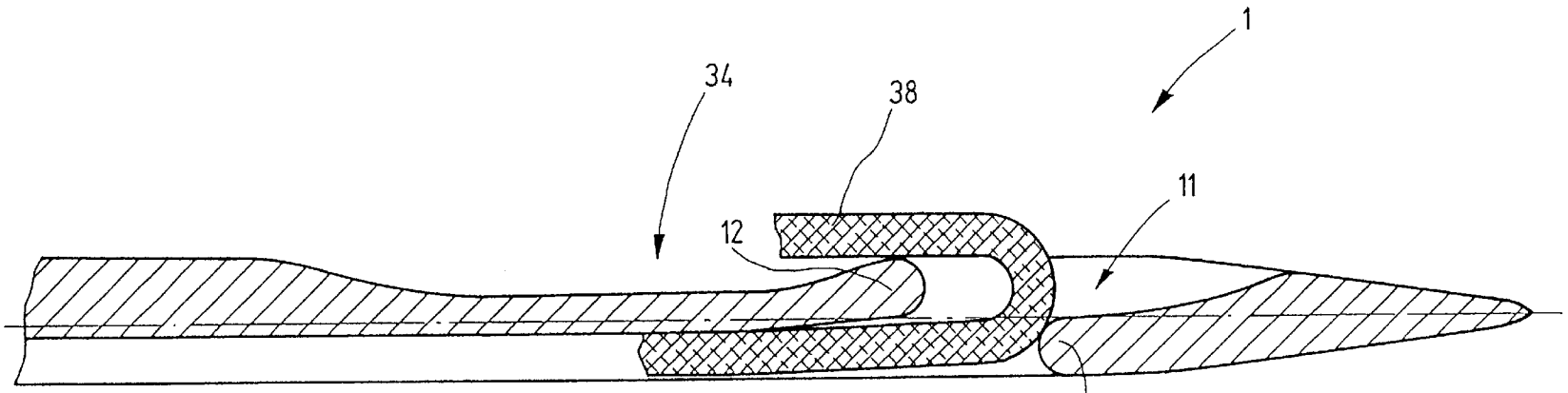
FIG. 5 is a view similar to FIG. 1, showing the position of the thread upon completion of the penetration step, at the start of the return stroke.
Figure 6:
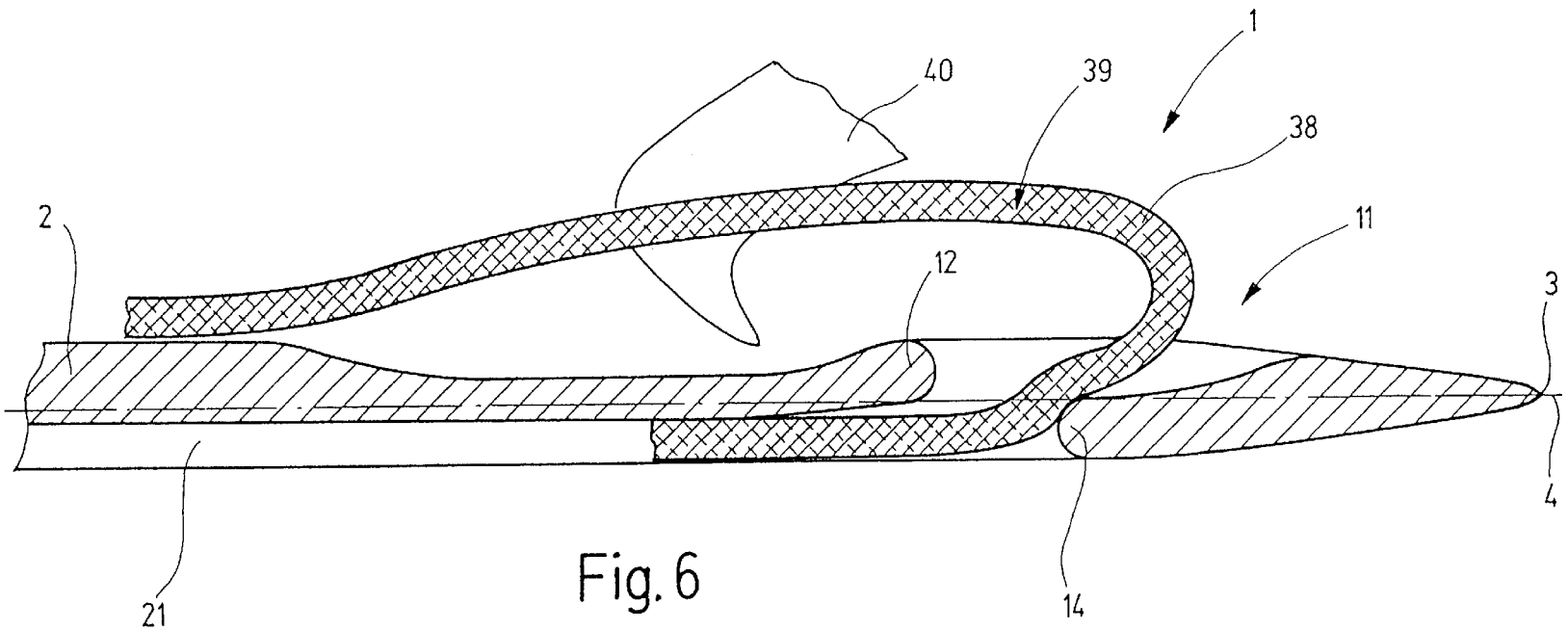
FIG. 6 is a view similar to FIG. 1, depicting the thread during the return stroke of the needle as an ideal loop is formed for engagement by a loop gripper.

In the further course of the sewing process, the direction of motion of the needle 1 is again reversed as illustrated in FIG. 5. The thread 38 inserted by the needle 1 into the fabric lifts off the eye web 12. A loop remains which is first still situated in the eye 11 and which is, by means of the leftward moving eye web 14, subsequently forced out of the eye 11 in the desired direction, that is, vertically upwardly as viewed in FIG. 5. During this occurrence, which is illustrated in FIG. 6, a loop 39 is formed which may be received by a gripper 40 for forming a seam. An accurate configuration of the loop 39 is of decisive significance for the sewing process. Thereafter, during its return stroke, the needle again travels through the stitch hole. While doing so, the thread 38 is pulled with high speed in a direction opposite the needle motion for looping around the bobbin cartridge. The stitching cycle is repeated after the needle 1 has been pulled out of the stitch hole and the thread 38 is pulled tight.

In recapitulation, the sewing machine needle according to the invention has an eye 11 which is bordered in the axial direction by two eye webs 12, 14 and which is relatively short a s viewed along the central axis 4. Its length is not substantially greater than the nominal thickness of the needle 1. The eye webs 12, 14 are offset with respect to one another; each eye web 12, 14 is approximately one-half the thickness of the needle 1 in the region of the eye 11. By virtue of these relationships, a stable and slender sewing machine needle is provided which, based on its slender shape, opens the stitch holes relatively slowly and thus performs the sewing operation in a gentle manner even at very high stitching speeds and, at the same time, provides for a substantially fully protected run of the thread.

It will be understood that the above description of the present invention is susceptible to various modifications, changes and adaptations, and the same are intended to the comprehended within the meaning and range of equivalents of the appended claims.

What is claimed is:

1. A sewing machine needle comprising a substantially linear blade having a longitudinal axis and terminating in a needle point; an eye provided in said blade; said eye being bordered by two eye webs spaced from one another parallel to said axis; said eye webs being offset relative to one another transversely to said axis; each said eye web having an end surface and the end surfaces being oriented toward one another; each said eye web having a bottom surface and a transitional region connecting a respective said bottom surface with a respective said end surface; each said bottom surface lying on said axis.

2. The sewing machine needle as defined in claim 1, wherein each said eve web has a web thickness and further wherein each said eye web has a rounded surface whose radius of curvature is substantially one half of the web thickness.

3. The sewing machine needle as defined in claim 1, wherein said needle has a nominal thickness and further wherein said eye webs are offset relative to one another transversely to said axis to an extent that is at least 40% of the nominal thickness.

4. The sewing machine needle as defined in claim 1, wherein said needle has a nominal thickness and further wherein said eye webs are offset relative to one another transversely to said axis to an extent that is 50% of the nominal thickness.

5. The sewing machine needle as defined in claim 1, wherein said needle has a nominal thickness and further wherein each said eye web has a web thickness measured transversely to said axis; said web thickness being at least 40% of said nominal thickness.

6. The sewing machine needle as defined in claim 1, wherein said needle has a nominal thickness and further wherein each said eye web has a web thickness measured transversely to said axis; said web thickness being 50% of said nominal thickness.

7. The sewing machine needle as defined in claim 1, wherein an imaginary straight line passing through said eye and lying on said bottom surfaces of respective said eye webs forms an angle of less than 20° with said axis.

8. The sewing machine needle as defined in claim 1, wherein at least one of the bottom surfaces is concave.

9. The sewing machine needle as defined in claim 1, wherein each said bottom surfaces are concave.

10. The sewing machine needle as defined in claim 1, wherein said needle has a nominal thickness and further wherein a length of said eye measured along said axis is less than twice the nominal thickness.

11. The sewing machine needle as defined in claim 1, wherein said needle has a nominal thickness and further wherein a length of said eye measured along said axis is 1 to 1.1 times the nominal thickness.

12. The sewing machine needle as defined in claim 1, wherein each said bottom surface borders a thread trough.

13. The sewing machine needle as defined in claim 1, wherein said eye has a passage traversing said blade and oppositely located eye walls each having a wall surface bordering said passage; and further wherein the wall surfaces form angles with one another; said angles being different from one another at locations spaced along said passage.

14. The sewing machine needle as defined in claim 1, wherein said needle has a nominal thickness; and further wherein said eye has a height measured along an imaginary line oriented perpendicularly to said axis and extending through said eye; said height being less than the nominal thickness.

15. The sewing machine needle as defined in claim 1, wherein a first of said two eye webs is at a greater distance from said point than a second of said two eye webs; said eye having eye walls adjoining said first eye web; said eye walls remaining laterally within confines of said first eye web.

* * * * *